US007497315B2

(12) United States Patent
Fargo et al.

(10) Patent No.: US 7,497,315 B2
(45) Date of Patent: Mar. 3, 2009

(54) ESCALATOR DRIVE SYSTEM FAILURE DETECTION AND BRAKE ACTIVATION

(75) Inventors: Richard Fargo, Plainville, CT (US); Helmut Meyer, Buckeberg (DE); Frank Sansevero, Glastonbury, CT (US); Markus Hame, Stadthagen (DE); Hermann Wiese, Buckeburg (DE)

(73) Assignee: Otis Elevator Company, Farmington, CT (US)

( * ) Notice: Subject to any disclaimer, the term of this patent is extended or adjusted under 35 U.S.C. 154(b) by 479 days.

(21) Appl. No.: 10/513,865

(22) PCT Filed: Feb. 7, 2003

(86) PCT No.: PCT/US03/03772

§ 371 (c)(1),
(2), (4) Date: Nov. 8, 2004

(87) PCT Pub. No.: WO03/099698

PCT Pub. Date: Dec. 4, 2003

(65) Prior Publication Data

US 2005/0173223 A1 Aug. 11, 2005

(51) Int. Cl.
*B66B 23/06* (2006.01)

(52) U.S. Cl. ..... 198/323; 198/322

(58) Field of Classification Search ..... 198/322, 198/323, 330

See application file for complete search history.

(56) References Cited

U.S. PATENT DOCUMENTS 3,866,725 A 2/1975 Greutter
4,056,759 A * 11/1977 Mitsui et al. ..... 318/98
4,151,381 A 4/1979 Holuba
4,231,452 A * 11/1980 Kraft ..... 188/171
4,232,776 A * 11/1980 Dean ..... 198/322
4,548,316 A * 10/1985 Maurer ..... 198/832.2
4,863,006 A 9/1989 Kotkata et al.
5,024,314 A * 6/1991 Kitamura et al. ..... 198/333
5,072,820 A * 12/1991 Steffen et al. ..... 198/323
5,090,551 A * 2/1992 Yasuhara et al. ..... 198/323
5,099,977 A * 3/1992 Hirose et al. ..... 198/323
5,236,075 A 8/1993 Bartmann (Continued)

OTHER PUBLICATIONS

PCT International Search Report, Jul. 14, 2003.

(Continued)

*Primary Examiner*—Douglas A Hess
(74) *Attorney, Agent, or Firm*—Carlson, Gaskey & Olds

(57) ABSTRACT

An escalator drive assembly (30) includes a sensor that facilitates detecting when the normal drive assembly operation is interrupted, such that a brake should be activated. In one example, a sensor member (40) in the form of a flange (42) is associated with a drive pulley (34) and normally rotates in unison with the drive pulley. When there is a failure in the normal operation of the drive mechanism, however, there is a resulting relative movement between the sensor member (40) and the drive pulley (34). Such relative motion preferably activates a switch (80) that provides a signal that indicates a failure of the normal operation of the drive mechanism (30). Another example sensor includes a sensor member (202, 212) that engages a drive belt (35). If the belt (35) breaks, the sensor member (202, 212) moves to provide an indication of the broken belt condition. Various braking application modes are possible using the invention.

22 Claims, 7 Drawing Sheets

U.S. PATENT DOCUMENTS

| | | | | |
|---|---|---|---|---|
| 5,316,121 | A | 5/1994 | Zaharia et al. | |
| 5,361,887 | A | 11/1994 | Zaharia et al. | |
| 5,785,165 | A | 7/1998 | Stahlhut et al. | |
| 6,234,295 | B1 * | 5/2001 | Ogawa | 198/333 |
| 6,273,234 | B1 * | 8/2001 | Balzer-Apke et al. | 198/323 |
| 6,407,523 | B1 * | 6/2002 | Allan | 318/430 |
| 6,427,823 | B1 * | 8/2002 | Ishikawa et al. | 198/330 |
| 6,457,573 | B1 * | 10/2002 | Ostermeier et al. | 198/330 |
| 6,527,099 | B2 * | 3/2003 | Ostermeier et al. | 198/330 |
| 6,997,302 | B2 * | 2/2006 | Fargo et al. | 198/330 |

OTHER PUBLICATIONS

Patent Office of the People's Republic of China, First Office Action dated May 16, 2006, relating to Patent Application No. 03811389.9.

* cited by examiner

ESCALATOR DRIVE SYSTEM FAILURE DETECTION AND BRAKE ACTIVATION

FIELD OF THE INVENTION

This invention generally relates to escalator drive mechanisms. More particularly, this invention relates to a failure detection and brake activation arrangement for use in an escalator drive mechanism.

DESCRIPTION OF THE RELATED ART

Escalators are passenger conveyors that typically carry passengers between landings at different levels in buildings, for example. A chain of steps typically is driven using a motorized assembly. There are a variety of motorized assemblies proposed or currently in use. The introduction of new drive mechanisms necessitates new developments in control devices.

There are a variety of conditions when a brake should be activated to automatically stop or prevent further movement of an escalator step chain. When there is a failure of drive transmission between the motor and the step chain, for example, there is a need to control the position of the escalator steps. Without the motive force of the motor, normal gravitational forces may cause undesirable movement of the escalator steps, for example.

This invention provides a sensor and brake activation mechanism that provides an indication of when the normal drive operation has failed and facilitates brake activation.

SUMMARY OF THE INVENTION

In general terms, this invention is a sensor that provides an indication of whether a passenger conveyor drive assembly is working as intended and facilitates applying a brake to prevent further movement of the conveyor.

One example assembly designed according to this invention includes a motor and a drive member that moves responsive to a motive force from the motor. A driven member is engaged by the drive member such that the driven member moves responsive to movement of the drive member. When the driven member moves, that results in movement of the passenger conveyor. A sensor member moves relative to a selected portion of the drive assembly when there is a failure of the drive assembly. Such movement of the sensor member provides an indication that the brake should be applied, for example.

The sensor member in one example rotates in unison with the drive member under normal operating conditions. The sensor member engages the driven member and moves to provide the indication that braking is needed responsive to relative movement between the drive member and the driven member.

In one example, the drive member comprises a drive pulley and a drive belt. The driven member comprises a step chain, which has a plurality of links. Teeth on the drive belt engage corresponding teeth on the step chain during normal operation. In the event of a failure of the transmission of a drive force from the drive member to the driven member, at least one of the step chain links engages the sensor member. Under these circumstances, the sensor member, which in one example is a flange associated with the drive pulley, moves relative to the drive pulley a selected amount and thereby indicates the need to stop the escalator.

In one example, movement of the sensor member relative to drive member activates a switch that provides a signal indicating a problem with the normal, expected operation of the escalator drive assembly. The switch serves to activate a brake for stopping the escalator system.

In another example, the sensor member is biased into engagement with the drive belt. If the drive belt is broken, the sensor member moves because the belt is no longer in its expected position. Such movement of the sensor member provides the indication that a brake should be applied.

The various advantages and features of this invention will become apparent to those skilled in the art from the following detailed description of the currently preferred arrangements. The drawings that accompany the detailed description can be briefly described as follows.

DETAILED DESCRIPTION OF THE PREFERRED EMBODIMENTS

Figure 1:
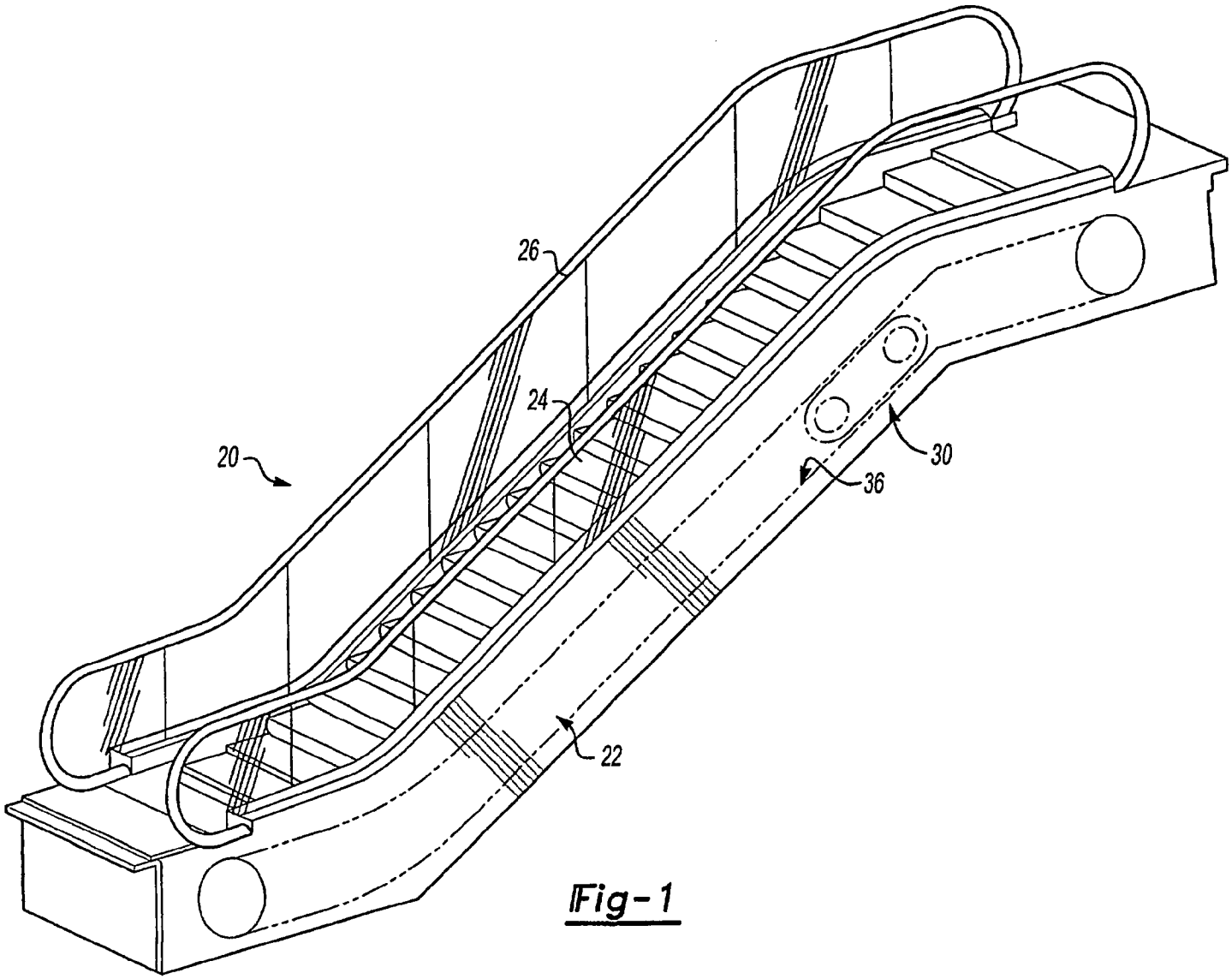
FIG. 1 diagrammatically illustrates an escalator system designed according to this invention.

An escalator system 20 is shown in FIG. 1 that includes a conventional escalator support structure 22 for supporting a plurality of steps 24 and a hand rail 26 to move passengers between floors in a building, for example. A drive mechanism 30 operates to move the steps 24 in a chosen direction at a desired speed under normal operating conditions.

Figure 2A:
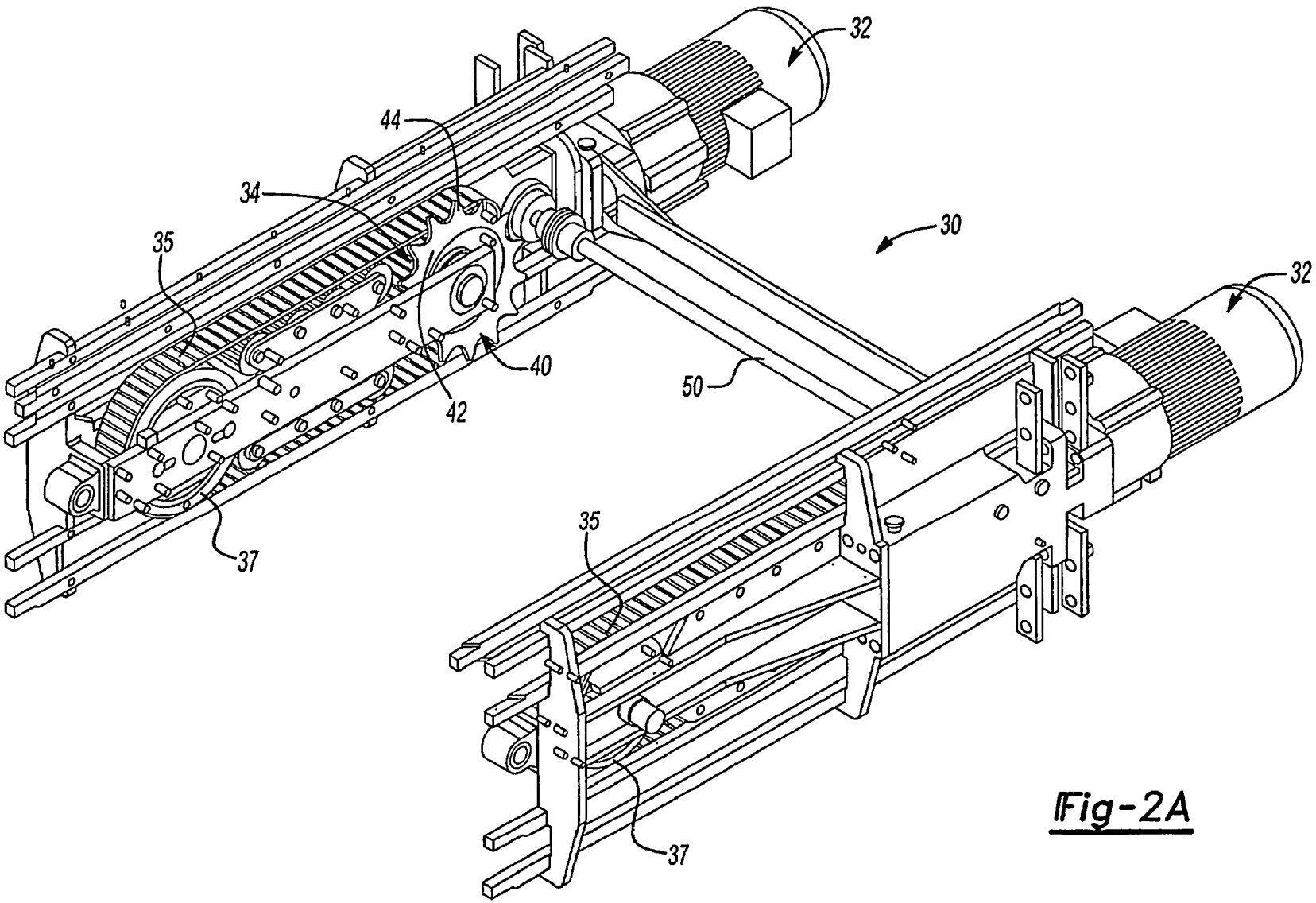
FIGS. 2A and 2B illustrate in somewhat more detail selected components of an example escalator drive assembly including an example sensor designed according to this invention.
Figure 2B:
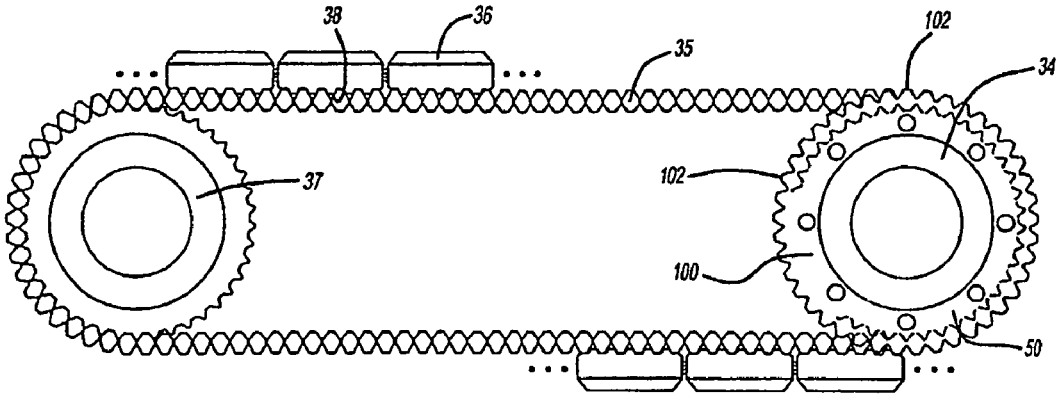

Referring to FIGS. 2A and 2B, for example, the drive mechanism 30 includes a motor assembly 32 that preferably has a motor and a brake. The motor 32 provides a motive force to a drive pulley 34. A cogged belt 35 preferably is driven by the motor 32 and drive pulley 34. In this example, the belt has reinforcing cords encased in a polyurethane material. Internal teeth on the belt cooperate with external teeth on the drive pulley 34.

The motive force on the belt 35 preferably is transferred to a plurality of step chain links 36 as the belt 35 travels around a loop set by the drive pulley 34 and an idler pulley 37. In one example, the belt 35 has external teeth that engage a plurality of cooperatively shaped teeth 38 on the step chain links 36. Under normal operating conditions, the belt 35 and the step chain links 36 move in unison, based upon the speed of movement of the drive pulley 34.

The engagement between the teeth on the drive belt 35 and the corresponding teeth 38 on the step chain links 36 provides the desired movement of the escalator steps as the step chain links 36 are associated with the steps in a manner sufficient to cause such movement. Accordingly, the step chain links 36 preferably follow the entire path of the steps while the drive belt 35 travels around a much shorter loop.

A synchronizer bar 50 extends approximately the width of the steps so that drive belts 35 and sets of step chain links 36 associated with the edges of the steps, respectively, move synchronously to provide smooth and reliable operation of the conveyor.

The inventive arrangement includes a sensor that provides an indication of an undesirable condition of the drive mechanism 30. In this example, the sensor includes a sensor member 40 associated with the drive pulley 34. The sensor member 40 preferably includes a flange body portion 42 with a plurality of radially extending portions 44. In the illustrated example of FIG. 2A, the sensor member 40 is generally star-shaped. The illustration of FIG. 2B has the sensor member 40 removed.

Under normal operating conditions, the sensor member 40 rotates in unison with the drive pulley 34 and has no effect on step chain movement. When there is a failure in the normal operation of the drive mechanism such as when the belt 35 is broken or damaged, however, there is relative movement between the drive pulley 34 and the step chain links 36. Under such circumstances, a portion of at least one of the step chain links 36 engages at least one of the radially extending portions 44 on the sensor member 40 causing the sensor member 40 to rotate relative to the drive pulley 34. Such relative motion between the drive pulley 34 and the sensor member 40 instigates an indication that the drive assembly has failed to operate as normally desired.

Figure 3:
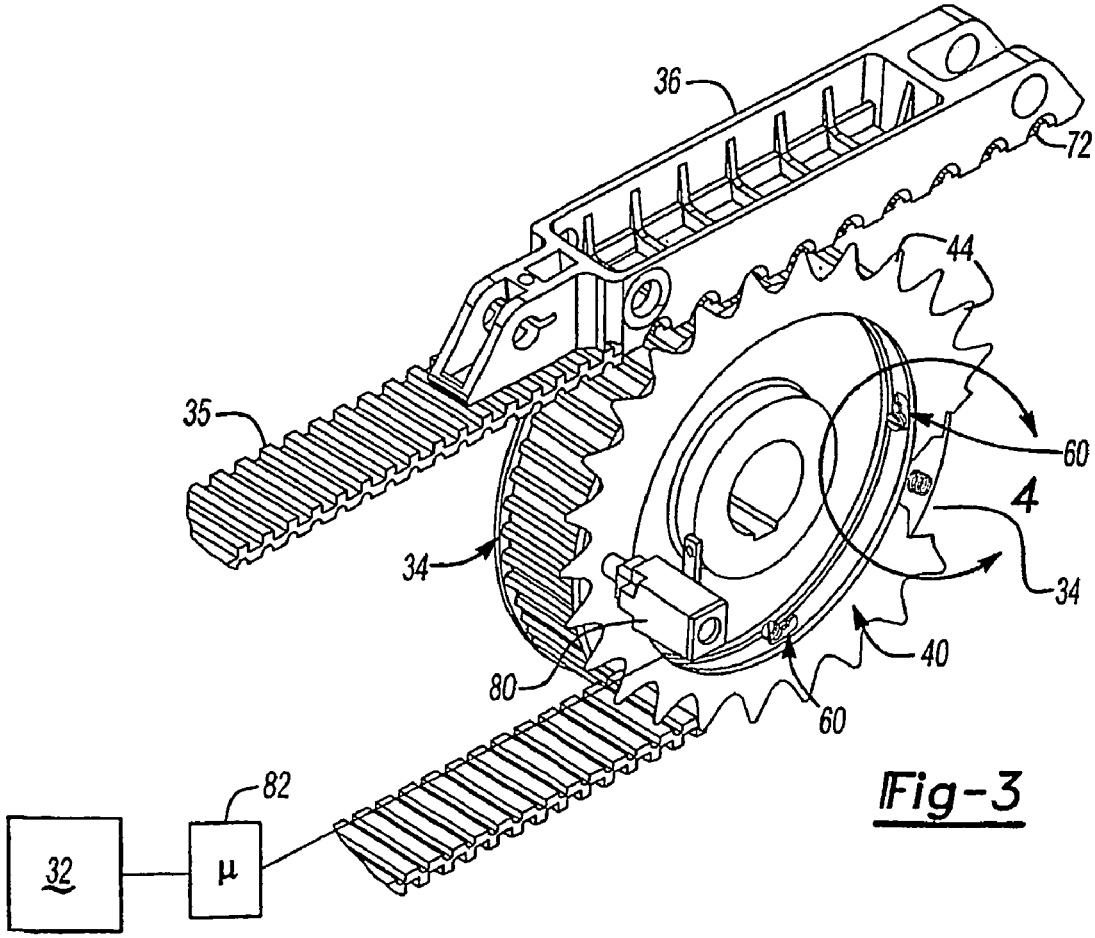
FIG. 3 illustrates selected portions of the embodiment of FIG. 2A.
Figure 4:
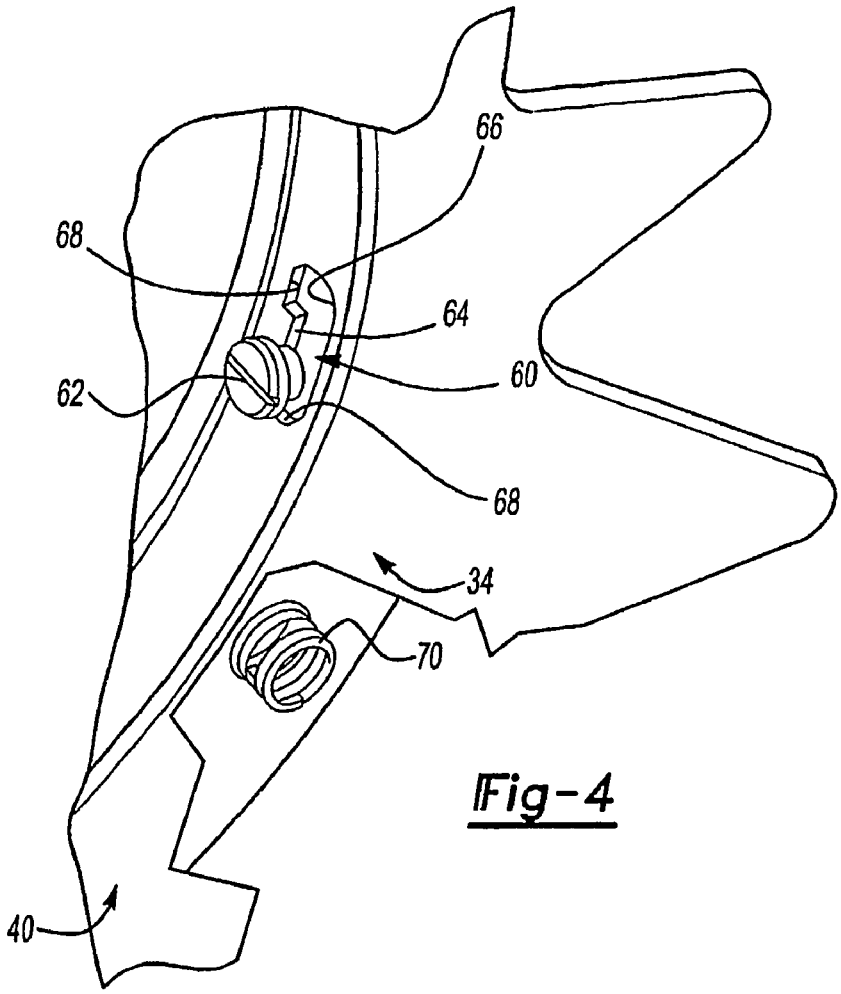
FIG. 4 illustrates, in somewhat more detail, the portion of FIG. 3 encircled in the circle labeled 4.

One example arrangement that utilizes limited relative movement between the sensor member 40 and the drive pulley 34 is illustrated in FIGS. 3 and 4. In this example, the sensor member 40 normally rotates with the drive pulley 34. A synchronization arrangement 60 keeps the two rotating together under normal operating conditions.

The sensor member 40 preferably is initially oriented relative to the drive pulley 34 so that a stop member 62, which is a bolt secured to the drive pulley 34 in the illustrated example, is positioned against a support surface 64 within a generally arcuate slot 66 formed on the sensor member 40. The support surface 64 preferably includes a partially rounded contour to stabilize the bolt 62 against the surface 64. The bolt 62 is shown in one end 68 of the slot 66.

A spring 70 normally biases the sensor member 40 away from the drive pulley 34 in a direction parallel to the axis of rotation of the drive pulley. In the initial, normal operating position, the spring 70 operates to assist maintaining the bolt 62 on the support surface 64. The contour of the surface 64 and the bias of the spring 70 preferably are set so that a desired minimal amount of force is required to cause movement of the bolt 62 within the slot 66.

As can be appreciated from FIGS. 3 and 4, a plurality of the synchronizing arrangements 60 preferably are provided spaced about on the drive pulley 34 and the sensor member 40.

When there is relative movement between the step chain links 36 and the drive pulley 34, engagement between the sensor member 40 and the step chain links 36 causes relative movement between the drive pulley 34 and the sensor member 40. Depending on the direction of such relative movement, the bolts 62 leave the surfaces 64 and slide into one of the ends 68 of the generally arcuate slots 66. Such movement of the bolts 62 within the slots 66 is the result of the relative rotary movement between the drive pulley 34 and the sensor member 40.

Figure 5:
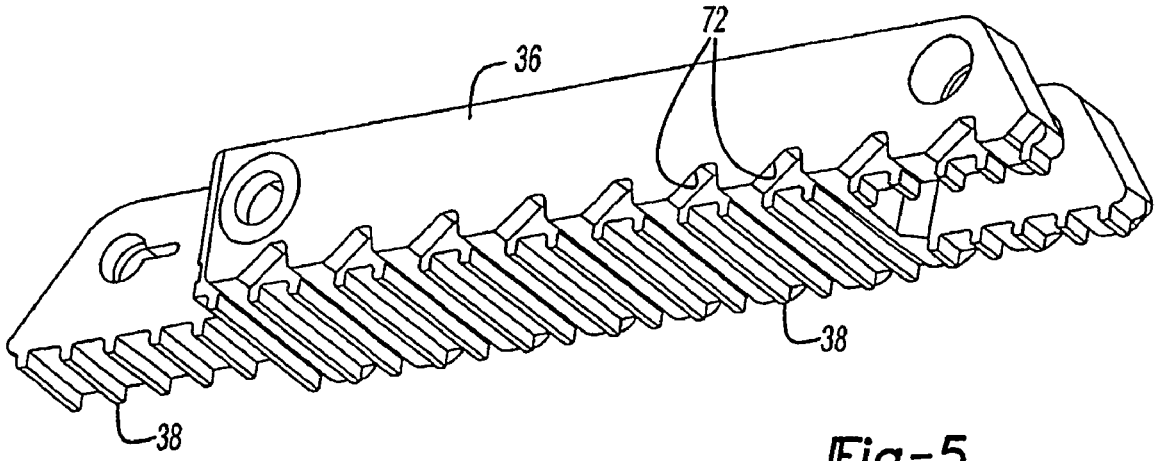
FIG. 5 illustrates selected features of the step chain links used in the example of FIG. 3.

In the examples of FIGS. 3 through 5, the radial projections 44 on the sensor member 40 preferably cooperate with reference surfaces 72 that are formed on the step chain links 36. Under normal operating conditions, the radial projections 44 follow the reference surfaces 72 but do not engage them. When there is relative movement between the drive pulley 34 and the step chain links 36, the cooperation between the reference surfaces 72 and the radial projections 44 causes the relative movement between the drive pulley 34 and the sensor member 40. In one example, the teeth 38 on the step chain links 36 are formed during a casting process while the reference surfaces 72 are machined in separately. This invention is not limited to such an arrangement. As can be appreciated, a variety of configurations are within the scope of this invention for causing cooperative movement between the step chain links 36 and the sensor member 40.

The spring 70 causes relative outward movement of the sensor member 40 further away from the drive pulley 34 as the bolts 62 move into an end 68 of the slots 66. Such movement preferably activates a switch 80. The switch 80 preferably is positioned relative to the sensor member 40 in such an embodiment so that the switch becomes activated at the time that there is relative movement between the step chain links 36 and the drive pulley 34. Activation of the switch 80, therefore, provides an indication of some failure in the drive connection between the drive pulley 34 and the step chain links 36.

In the illustrated example, an electrical signal generated by the switch 80 is received by a controller 82 that controls operation of the motor and brake assembly 32. In one example, the controller 82 is an integral part of the motor assembly. The controller 82 preferably controls the operation of the motor assembly and brake to ensure that the escalator steps 24 do not move in an undesirable fashion after the normal operation of the drive assembly has been interrupted.

The controller 82 may be, for example, a conventional microprocessor that is suitably programmed to interpret signals from the switch 80 and to correspondingly control the motor and brake assembly 32. In one example, the controller 82 is part of a controller already associated with the escalator system. In another example, the controller 82 is a dedicated microprocessor. Given this description, those skilled in the art will be able to choose from among commercially available components and to suitably program a computer or controller to perform the functions required to realize the results provided by this invention.

Some failures of the drive mechanism 30 (i.e., when the belt 35 is broken) will not allow the drive pulley 34 to exert any drive or braking force on the step chain links 36. For such situations, some example embodiments of this invention include a backup feature that operates separately from the sensor function described above. Referring again to FIG. 2B, the drive pulley 34 includes a backup flange 100. The illustration of FIG. 2B has the sensor member 40 removed compared to the illustration of FIG. 2A or FIG. 3, for example, to expose the backup flange 100, which is hidden from view in FIGS. 2A and 3.

The backup flange 100 in this example preferably designed according to the teachings of the published application WO 02062694, which is commonly owned with this application. The backup flange 100 in this example is fixed to remain stationary relative to the drive pulley 34. The backup flange 100 includes a plurality of teeth 102 that are adapted to selectively engage the reference surfaces 72 on the step chain links 36 in the event that the normal engagement between the drive pulley 34, drive belt 35 and the step chain links 36 fails. Under such situations, the teeth 102 transmit a driving or braking force to the step chain links 36 based upon the operation of the motor and brake assembly of the drive mechanism 30. In this example, the teeth 102 normally do not engage the reference surfaces 72 but only follow them as the drive pulley 34 and the drive belt 35 rotate.

In one example, the teeth 102 of the backup flange 100 lead the radially extending portions 44 of the sensor 40 by a small amount. In one example, a one millimeter difference preferably is provided between the position of the teeth 102 on the backup flange 100 and the radially extending portions 44 on the sensor member 40. In such examples, once the backup flange 100 is loaded because of the relative motion between the drive pulley 34 and the step chain links 36, the sensor member projections 44 become aligned with the teeth 102 on the backup flange 100. As they move into such alignment, the sensor member 40 activates the switch 80 and the controller 82 takes appropriate action.

A backup flange such as the example flange 100 preferably is included in the drive assembly, regardless of the chosen sensor embodiment. By separating the backup and sensing functions using a sensor designed according to this invention, it is possible to provide the necessary amount of force transmission during a backup brake application while avoiding undesirable false trips of the sensor arrangement.

Figure 6:
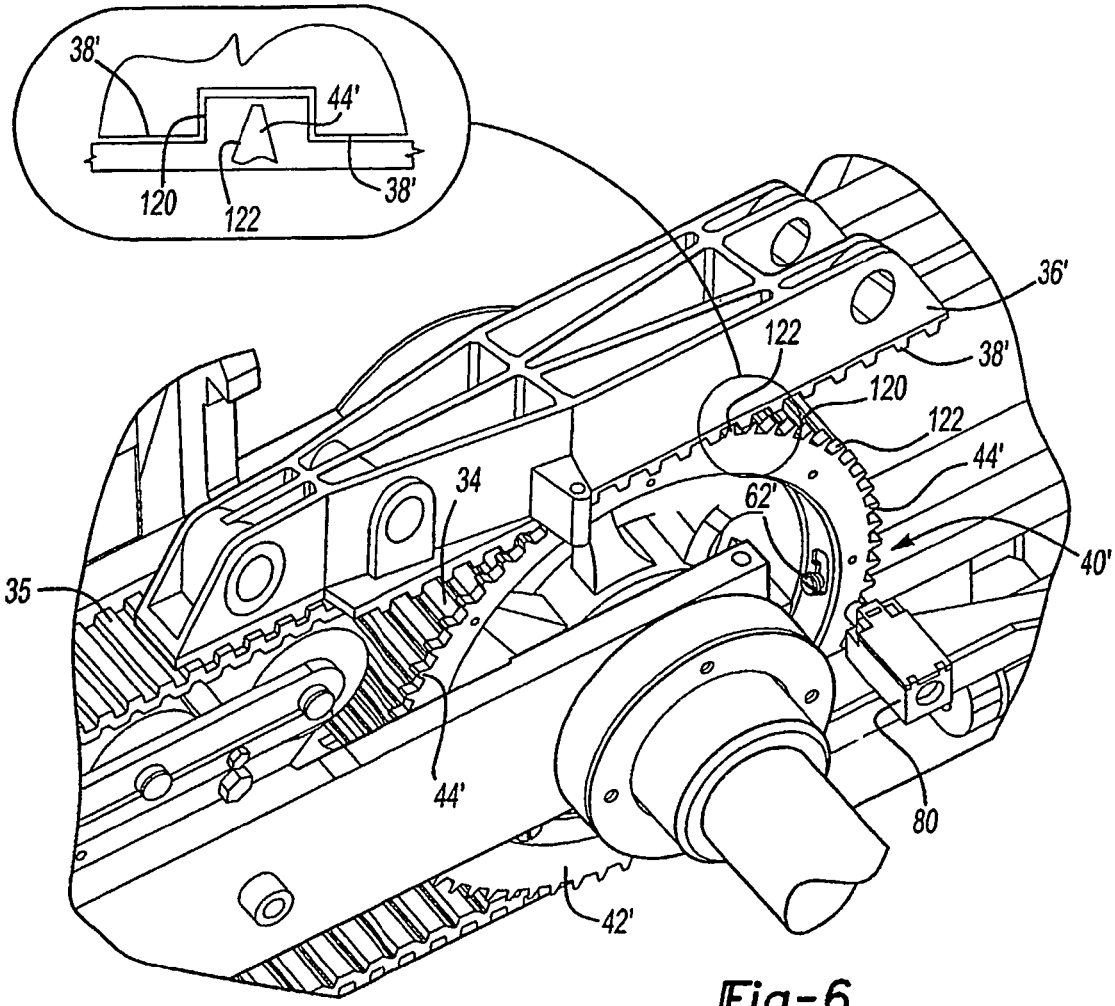
FIG. 6 illustrates selected features of another example sensor embodiment.

Another example sensor 40' designed according to this invention is illustrated in FIG. 6. The operation of this example preferably is much like that of FIGS. 3 and 4 with the exception of the engagement between the sensor flange portion 42' and the step chain links 36'. In this example, the step chain links 36' preferably do not include the reference surfaces 72. Instead, the flange projections 44' directly engage the teeth 38' on the step chain links 36', which are normally in engagement with the teeth on the drive belt 35, to provide an indication of a failure in the normal operation of the drive system. Otherwise, the movement and support of the flange 42' is functionally identical to that of the flange 42 in FIGS. 3 and 4.

As can be appreciated from the illustration, the teeth 120 on the drive belt 35 lead the forward edges 122 of the radial projections 44' such that the belt teeth 120 normally engage the teeth 38' on the step chain links 36', but the projections 44' do not. If the drive belt 35 is broken or worn such that the drive force of the drive pulley 34 is no longer transmitted to the step chain, the projections 44' engage the step chain link teeth 38'. As the flange portion 42' moves relative to the drive pulley 34, the sensor 40' provides the desired indication of the detected condition of the drive assembly in a manner similar to that of the flange 42 described above.

Figure 7:
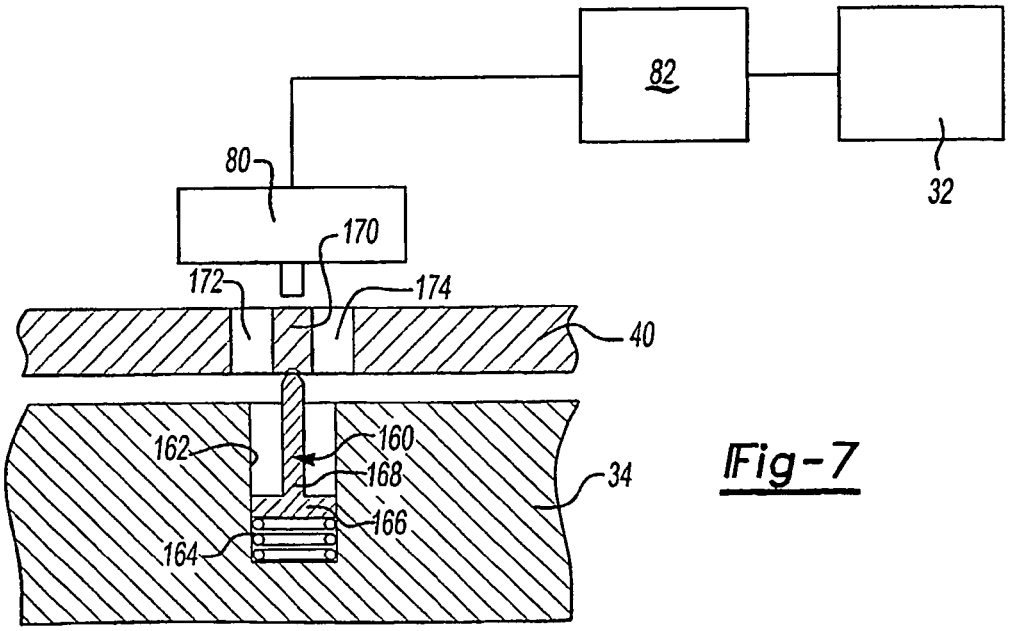
FIG. 7 illustrates selected components of another switch activating embodiment in a first position.
Figure 8:
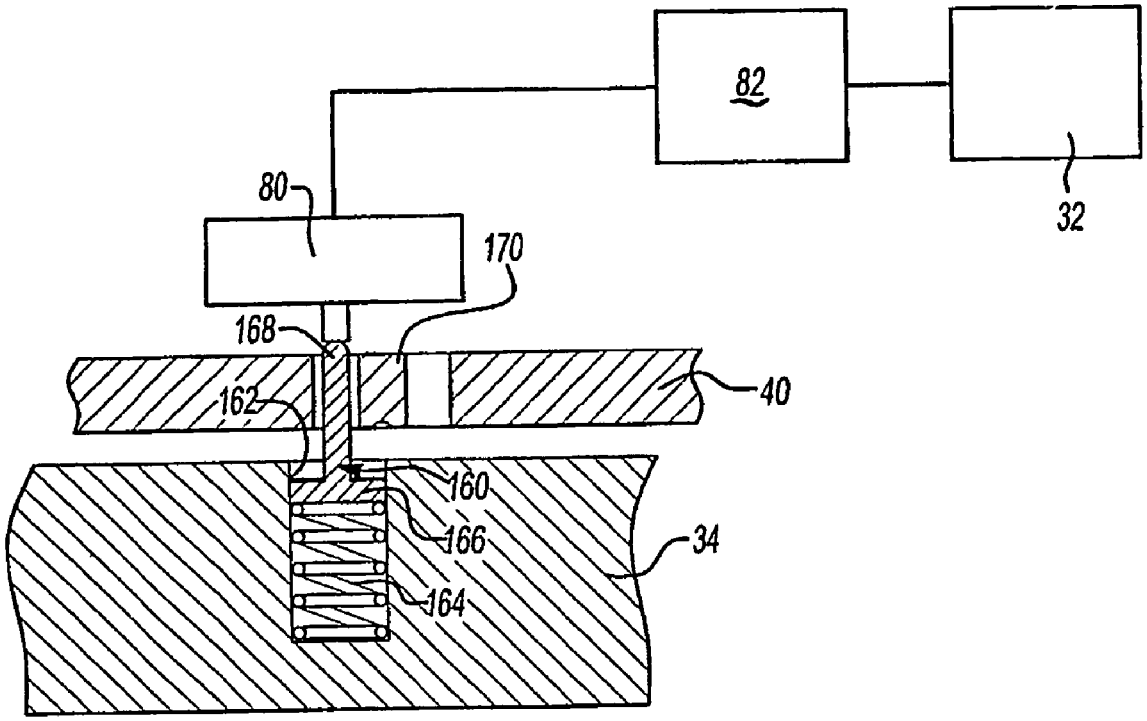
FIG. 8 illustrates the components of FIG. 7 in a second position.

Another example sensor embodiment is illustrated in FIGS. 7 and 8. In this example, the sensor includes a pin 160 that cooperates with the switch 80 rather than cooperation directly between the flange portion 44 of the sensor member 40 and the switch 80 as occurs in the previously discussed examples.

The drive pulley 34 in this example preferably supports a pin 160 within a receiver portion 162, which may be a bore in the drive pulley, for example. A biasing member 164, such as a spring, urges the pin 160 in a direction out of the receiver portion 162. The illustrated example of the pin 160 includes a base portion 166 and an extending arm 168.

FIG. 7 illustrates the pin 160 in a first position within the receiver portion 162. A solid portion 170 on the sensor member 40 maintains the pin 160 in a recessed position within the receiver portion 162. An opening 172 is provided on one side of the solid portion 170 while a second opening 174 is provided on an opposite side. When there is relative rotation between the sensor member 40 and the drive pulley 34, the pin arm 168 is biased out of the receiver portion 162 and through a corresponding opening 172 or 174. This can be appreciated from FIG. 8, for example.

Figure 9:
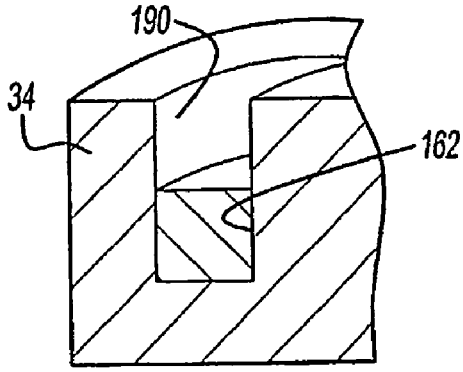
FIG. 9 diagrammatically illustrates a selected feature of the example sensor arrangement of FIGS. 6 and 7.

In the illustrated example, the pin 160 is allowed to slide within a slot in the drive pulley 34 after the pin has extended through one of the openings in the sensor member 40. Such an arrangement is schematically illustrated in FIG. 9 where a portion of the drive pulley 34 is shown. The receiver portion 162 extends a first depth into the drive pulley 34. An arcuate groove 190 is coincident with the receiver portion 162 but does not extend as deep into the body of the drive pulley 34. Therefore, when the pin is in a first position as illustrated in FIG. 7, it is maintained in the receiver portion 162. After the pin 160 has extended through an opening in the sensor member 40, however, the base 166 is free to slide within the groove 190 so that there can be a desired amount of relative rotation between the drive pulley 34 and the sensor member 40. Such relative rotation with the pin 160 in the groove 190 prevents the pin from being broken or sheared as a result of any forces associated with relative movement between the sensor member 40 and the drive pulley 34.

Figure 10:
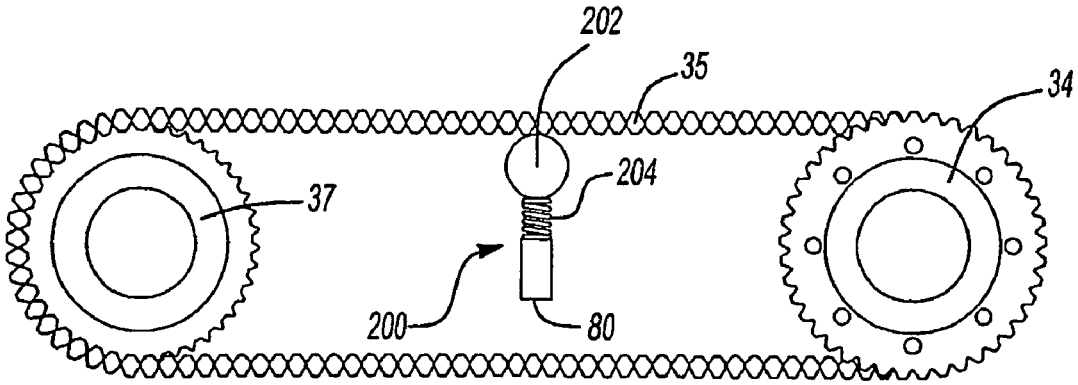
FIG. 10 schematically illustrates another example sensor designed according to this invention.

FIG. 10 schematically illustrates another example sensor arrangement designed according to this invention. In this example, the sensor is particularly suited for directly monitoring the condition of the drive belts 35 and triggering the brake device 32 responsive to a determination that at least one belt 35 is not performing as desired. In this example, the sensor 200 includes a roller 202 that is biased into engagement with the inner side of the belt 35. In this example, a coil spring biasing member 204 urges the roller 202 into engagement with the inner surface of the belt 35. If the belt is broken, it will no longer travel about the loop established by the drive sheave 34 and the idler sheave 37. Accordingly, the roller 202 will move outward (i.e., upward according to the illustration) and provide an indication as the roller moves in that direction. As the roller 202 moves responsive to the absence of the belt 35, the switch 80 communicates the need for the controller 82 to activate the brake mechanism 32 to apply a braking force. Given this description, those skilled in the art will be able to select appropriate switching components to achieve such brake application, depending on the particular configuration and the needs of their particular system design.

Figure 11:
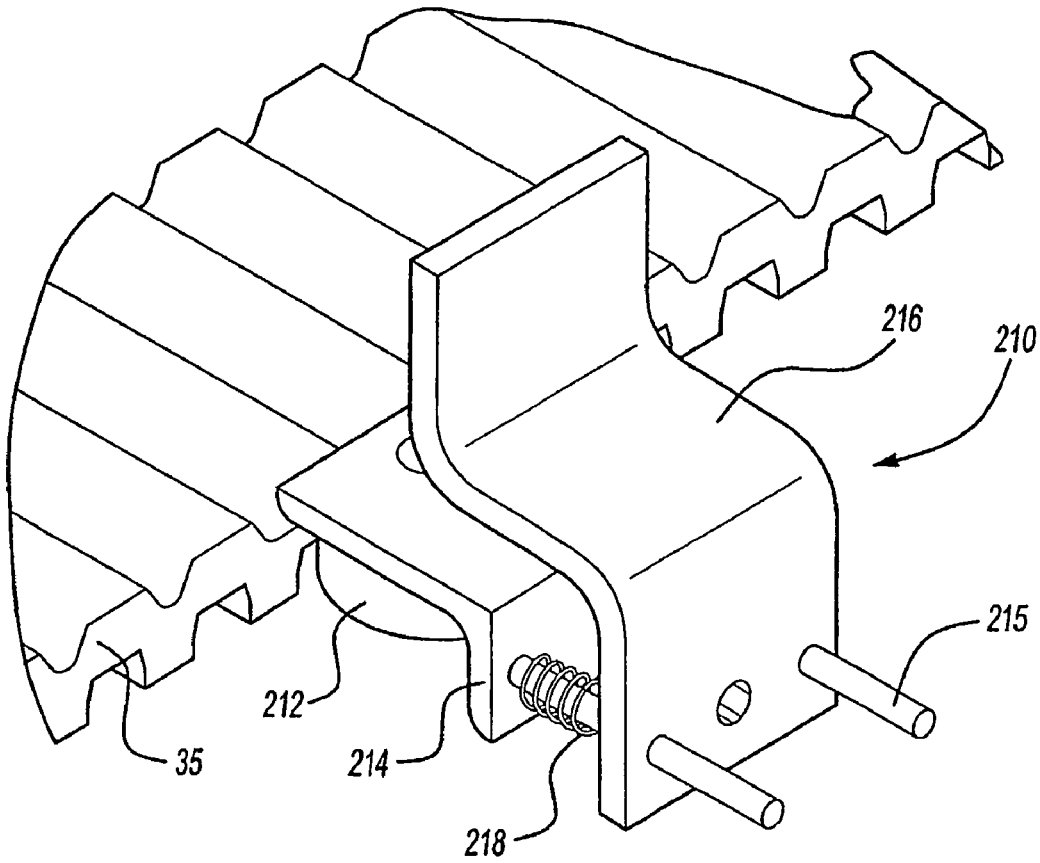
FIG. 11 schematically illustrates another example sensor designed according to this invention.

FIG. 11 shows another example belt sensor 210. In this example, a roller 212 is rotatably supported on a support member 214. Shafts 215 extend from one side of the support 214 and are received through openings in a support bracket 216, which is secured to an appropriate portion of the structure supporting the drive assembly 30. The support 214 and the roller 212 are urged toward the belt 35 by a biasing member 218, which comprises two coil springs in this example.

Under normal operating conditions, the roller 212 rides along the side surface of the belt 35. If the belt becomes broken or displaced, the biasing member 218 urges the roller 212 to the left (according to the drawing). Such movement of the roller and the support bracket 214 actives the switch 80 indicating that the controller 82 should activate the brake device 32.

The examples of FIGS. 9 and 10 show some possible sensor arrangements for directly monitoring the presence or condition of the belt 35. In some situations, it may be desirable to monitor not only whether the belt is broken but whether the teeth on the belt are adequately engaging the teeth in the step chain links. It may happen, for example, that the belt teeth become worn or broken, even though the entire belt 35 is not broken. The examples of FIGS. 3 though 8 provide such monitoring capability.

The examples described above include a switch activation where electrical power is used to communicate signals indicating that a brake should be applied. Some situations may require a purely mechanical brake activating mechanism. For example, many codes require a mechanical brake application mechanism for applying an auxiliary brake (i.e., a supplemental brake to the brake associated with the motor and brake mechanism of the drive assembly). Any of the example sensor arrangements described above are useful for an electrical brake activation or a purely mechanical brake activation arrangement. The motion of the sensor members in the various embodiments are useful to activate a switch as described. In some examples, the motion of the sensor member is used to apply a physical force to move a linkage mechanism that mechanically activates a brake. For example, movement of the sensor member may pull upon a cable or a hard linkage member that, in turn, moves an appropriate portion of a mechanical brake activation arrangement.

The inventive arrangement is useful for activating a brake associated with a drive mechanism or an auxiliary brake for preventing further undesirable movement of a passenger conveyor system when the normal force transmission between the drive assembly and the steps is interrupted because of a failure or damage to one or more components of the drive mechanism.

This invention provides unique failure indicator and brake activation arrangements for escalator drive mechanisms. This invention is especially useful for escalator drive mechanisms that include a drive belt that is actuated by a drive pulley but is not necessarily limited to such arrangements.

The preceding description is exemplary rather than limiting in nature. Variations and modifications to the disclosed examples may become apparent to those skilled in the art that do not depart from the essence of this invention. The scope of legal protection given to this invention can only be determined by studying the following claims.

We claim:

1. A passenger conveyor drive assembly, comprising:

a motor;

a drive member that moves responsive to a motive force from the motor;

a driven member that moves responsive to movement of the drive member when there is sufficient engagement between the drive member and the driven member, movement of the driven member resulting in movement of a conveying surface of an associated passenger conveyor; and a sensor comprising a member that moves responsive to a change in the engagement between the drive member and the driven member to provide an indication of an undesirable condition of the drive assembly.

2. The assembly of claim 1, including a brake that is activated responsive to movement of the sensor member, the brake preventing further movement of the driven member.

3. The assembly of claim 2, including a brake switch and a controller that controls activation of the brake and wherein the movement of the sensor member causes the switch to provide a signal to the controller.

4. The assembly of claim 1, wherein the drive member comprises a drive sheave that rotates responsive to the force from the motor and wherein the sensor member comprises a flange that normally rotates with the drive sheave, the sensor movement comprising the flange rotating relative to the drive sheave responsive to relative movement between the drive member and the driven member.

5. The assembly of claim 4, wherein the drive member comprises a drive belt that moves with the drive sheave and the driven member comprises a chain, the sensor member having a plurality of radial projections that engage a corresponding portion of the driven chain during relative movement between the drive member and the driven member.

6. The assembly of claim 5, wherein the driven chain comprises a plurality of links each having a first set of teeth that engage a corresponding surface on the drive belt and a plurality of reference surfaces that engage the radial projections during the relative movement.

7. The assembly of claim 4, including a stop member that moves with the drive sheave, the sensor member including a slot through which at least a portion of the stop member is received, the stop member moving from a first position where the sensor member and the drive member move synchronously into a second position within the slot responsive to the relative movement between the drive member and the driven member.

8. The assembly of claim 7, including a biasing member that biases the sensor member away from the drive sheave, the biasing member causing relative movement between the drive sheave and the sensor member in a direction corresponding to movement of the stop member within the slot to the second position.

9. The assembly of claim 4, incLuding a pin associated with the drive member that is biased into an actuating position and wherein the sensor member maintains the pin out of the actuating position when the sensor member moves with the drive member but releases the pin to move into the actuating position responsive to relative movement between the drive member and the sensor member.

10. The assembly of claim 1, wherein the drive member comprises a belt and the sensor member is biased into engagement with the belt, the sensor member moving responsive to the bias when a condition of the belt changes.

11. The assembly of claim 10, wherein the sensor member comprises a roller biased against a lateral surface on the belt, the roller rotating about an axis responsive to movement of the belt and the roller moving laterally relative to the axis responsive to the change in the belt condition, the lateral movement providing the indication of the changed belt condition.

12. The assembly of claim 10, wherein the sensor member comprises a roller biased against an inside surface on the belt, the roller rotating about an axis responsive to movement of the belt and the roller moving laterally relative to the axis responsive to the change in the belt condition, the lateral movement providing the indication of the changed belt condition.

13. The assembly of claim 1, wherein the drive member comprises a pulley member driven by the motor, the driven member comprises a step chain having a plurality of links that are engaged by the engaging member such that the step chain moves responsive to movement of the drive member, and wherein the sensor member rotates in unison with the pulley member, the sensor member engaging a cooperating portion of the step chain and moving relative to the pulley member responsive to relative movement between the step chain and the pulley member.

14. The assembly of claim 13, wherein the drive member compises a belt that moves responsive to movement of the pulley member, the belt having a plurality of teeth that engage corresponding teeth on the step chain links.

15. The assembly of claim 13, including a brake associated with the motor and wherein the brake is actuated responsive to relative movement between the pulley member and sensor member.

16. The assembly of claim 13, including a biasing member that biases the sensor member away from the pulley member in a direction parallel to an axis of rotation of the pulley member, the biasing member operating to move the sensor member away from the pulley member to provide an indication of the relative movement between the pulley member and the sensor member.

17. The assembly of claim 13, wherein the step chain links include reference surfaces and the sensor member comprises a flange having a plurality of radial projections and wherein the radial projections engage the reference surfaces responsive to relative movement between the step chain and the pulley.

18. The assembly of claim 1, wherein the drive member comprises a pulley member driven by the motor and a belt that moves responsive to movement of the pulley member, the driven member comprises a step chain having a plurality of links that are engaged by the belt such that the step chain moves responsive to movement of the drive member; and the sensor member is biased toward and engages the belt, the sensor member moving beyond the engaged position responsive to a change in a condition of the belt, movement of the sensor member beyond the engaged position providing an indication of the change in belt condition.

19. The assembly of claim 18, wherein the sensor member comprises a roller biased against a lateral surface on the belt, the roller rotating about an axis responsive to movement of the belt and the roller moving laterally relative to the axis responsive to the change in a condition of the belt, the lateral movement providing the indication of the changed belt condition.

20. The assembly of claim 18, wherein the sensor member comprises a roller biased against an inside surface on the belt, the roller rotating about an axis responsive to movement of the belt and the roller moving laterally relative to the axis responsive to the change in a condition of the belt, the lateral movement providing the indication of the changed belt condition.

21. The assembly of claim 1, wherein the sensor moves responsive to relative movement between the drive member and the driven member.

22. The assembly of claim 1, wherein the drive member moves in at least one of two selectable driving directions; and the sensor is operative to provide the indication of the undesirable condition when the drive member is moving in either of the two driving directions.

* * * * *

UNITED STATES PATENT AND TRADEMARK OFFICE

CERTIFICATE OF CORRECTION

PATENT NO. : 7,497,315 B2
APPLICATION NO. : 10/513865
DATED : March 3, 2009
INVENTOR(S) : Fargo et al.

It is certified that error appears in the above-identified patent and that said Letters Patent is hereby corrected as shown below:

Claim 9, Column 8, Line 28: Change “incLuding” to read as “including”

Claim 15, Column 9, Line 3: Add “the” between “and” and “sensor”

Signed and Sealed this

Nineteenth Day of May, 2009

JOHN DOLL
*Acting Director of the United States Patent and Trademark Office*